US006502711B1

(12) United States Patent
Mc Rae

(10) Patent No.: US 6,502,711 B1
(45) Date of Patent: Jan. 7, 2003

(54) CONTAINER HOLDING APPARATUS

(76) Inventor: Kerry J. C. Mc Rae, RR 6 Site 672 C-21, Courtenay BC (CA), V9N 8H9

( * ) Notice: Subject to any disclaimer, the term of this patent is extended or adjusted under 35 U.S.C. 154(b) by 0 days.

(21) Appl. No.: 09/838,849

(22) Filed: Apr. 20, 2001

(51) Int. Cl.[7] ..... B65D 21/02

(52) U.S. Cl. ..... 220/23.4; 211/71.01; 211/74; 248/311.3

(58) Field of Search ..... 220/23.4, 23.88, 220/23.86, 737, 738; 248/311.3, 298.1, 152, 310, 346.5; 211/126.15, 71.01, 162, 74; 215/395; 206/591, 592, 306

(56) References Cited

U.S. PATENT DOCUMENTS

| | | | | | |
|---|---|---|---|---|---|
| 1,585,939 | A | * | 5/1926 | Roepke | 15/160 |
| 3,307,709 | A | * | 3/1967 | Hulterstrum | 211/85.19 |
| 3,338,452 | A | * | 8/1967 | Oakley et al. | 220/23.4 |
| 3,425,586 | A | * | 2/1969 | Petters et al. | 220/23.4 |
| 3,918,920 | A | * | 11/1975 | Barber | 422/104 |
| 3,941,237 | A | * | 3/1976 | MacGregor, Jr. | 198/867.13 |
| 4,271,878 | A | | 6/1981 | Bologa | |
| 4,439,884 | A | * | 4/1984 | Giorni | 15/104.04 |
| 4,905,949 | A | * | 3/1990 | Cosgrove | 248/312.1 |
| 4,960,254 | A | * | 10/1990 | Hartke | 248/146 |
| 5,024,067 | A | * | 6/1991 | Maier, II | 220/23.4 |
| 5,048,547 | A | * | 9/1991 | Walker | 132/73.5 |
| 5,080,150 | A | | 1/1992 | Deadwyler, Jr. | |
| 5,105,860 | A | | 4/1992 | Connor | |
| 5,215,133 | A | | 6/1993 | Lambert | |
| D360,114 | S | | 7/1995 | Whiteside, Jr. | |
| 5,460,298 | A | | 10/1995 | Dibiase et al. | |
| 5,482,095 | A | * | 1/1996 | DeChollet | 141/380 |
| 5,536,476 | A | * | 7/1996 | Baxter | 422/102 |
| 5,558,229 | A | * | 9/1996 | Halbich | 206/534 |
| 5,810,021 | A | * | 9/1998 | Walker | 132/74.5 |

* cited by examiner

*Primary Examiner*—Nathan J. Newhouse
*Assistant Examiner*—Joseph C. Merck

(57) ABSTRACT

A container holding apparatus for holding a container in an inverted orientation such that the contents of the container fall to the top of the container for easy retrieval. The container holding apparatus includes a plurality of tubular members each having a bottom edge, a top edge and a peripheral wall extending between the top and bottom edges. A plurality of supports are coupled to an inner surface of each of the tubular members and spaced from each other. Each of the supports extends from the inner surface toward a longitudinal axis orientated generally perpendicular to a plane of the top edge. A container is inverted and inserted into the tubular member such that the supports support the container in the inverted orientation.

8 Claims, 5 Drawing Sheets

CONTAINER HOLDING APPARATUS

BACKGROUND OF THE INVENTION

1. Field of the Invention

The present invention relates to container holding devices and more particularly pertains to a new container holding apparatus for holding a container in an inverted orientation such that the contents of the container fall to the top of the container for easy retrieval.

2. Description of the Prior Art

The use of container holding devices is known in the prior art. More specifically, container holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,122,133; U.S. Pat. No. 5,460,298; U.S. Pat. No. 5,080,150; U.S. Pat. No. 5,105,860; U.S. Pat. No. 4,271,878; and U.S. Des. Pat. No. 360,114.

While these devices fulfill their respective, particular objectives and requirements, the aforementioned patents do not disclose a new container holding apparatus. The inventive device includes a plurality of tubular members each having a bottom edge, a top edge and a peripheral wall extending between the top and bottom edges. A plurality of supports are coupled to an inner surface of each of the tubular members and spaced from each other. Each of the supports extends from the inner surface toward a longitudinal axis orientated generally perpendicular to a plane of the top edge. A container is inverted and inserted into the tubular member such that the supports support the container in the inverted orientation.

In these respects, the container holding apparatus according to the present invention substantially departs from the conventional concepts and designs of the prior art, and in so doing provides an apparatus primarily developed for the purpose of holding a container in an inverted orientation such that the contents of the container fall to the top of the container for easy retrieval.

SUMMARY OF THE INVENTION

In view of the foregoing disadvantages inherent in the known types of container holding devices now present in the prior art, the present invention provides a new container holding apparatus construction wherein the same can be utilized for holding a container in an inverted orientation such that the contents of the container fall to the top of the container for easy retrieval.

The general purpose of the present invention, which will be described subsequently in greater detail, is to provide a new container holding apparatus apparatus and method which has many of the advantages of the container holding devices mentioned heretofore and many novel features that result in a new container holding apparatus which is not anticipated, rendered obvious, suggested, or even implied by any of the prior art container holding devices, either alone or in any combination thereof.

To attain this, the present invention generally comprises a plurality of tubular members each having a bottom edge, a top edge and a peripheral wall extending between the top and bottom edges. A plurality of supports are coupled to an inner surface of each of the tubular members and spaced from each other. Each of the supports extends from the inner surface toward a longitudinal axis orientated generally perpendicular to a plane of the top edge. A container is inverted and inserted into the tubular member such that the supports support the container in the inverted orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container holding apparatus apparatus and method which has many of the advantages of the container holding devices mentioned heretofore and many novel features that result in a new container holding apparatus which is not anticipated, rendered obvious, suggested, or even implied by any of the prior art container holding devices, either alone or in any combination thereof.

It is another object of the present invention to provide a new container holding apparatus which may be easily and efficiently manufactured and marketed.

It is a further object of the present invention to provide a new container holding apparatus which is of a durable and reliable construction.

An even further object of the present invention is to provide a new container holding apparatus which is susceptible of a low cost of manufacture with regard to both materials and labor, and which accordingly is then susceptible of low prices of sale to the consuming public, thereby making such container holding apparatus economically available to the buying public.

Still yet another object of the present invention is to provide a new container holding apparatus which provides in the apparatuses and methods of the prior art some of the advantages thereof, while simultaneously overcoming some of the disadvantages normally associated therewith.

Still another object of the present invention is to provide a new container holding apparatus for holding a container in an inverted orientation such that the contents of the container fall to the top of the container for easy retrieval.

Yet another object of the present invention is to provide a new container holding apparatus which includes a plurality of tubular members each having a bottom edge, a top edge and a peripheral wall extending between the top and bottom edges. A plurality of supports are coupled to an inner surface of each of the tubular members and spaced from each other. Each of the supports extends from the inner surface toward a longitudinal axis orientated generally perpendicular to a plane of the top edge. A container is inverted and inserted into the tubular member such that the supports support the container in the inverted orientation.

Still yet another object of the present invention is to provide a new container holding apparatus that has a tray for containing any spillage from the containers.

Even still another object of the present invention is to provide a new container holding apparatus that has slots and protruding members for linking a plurality of containers together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
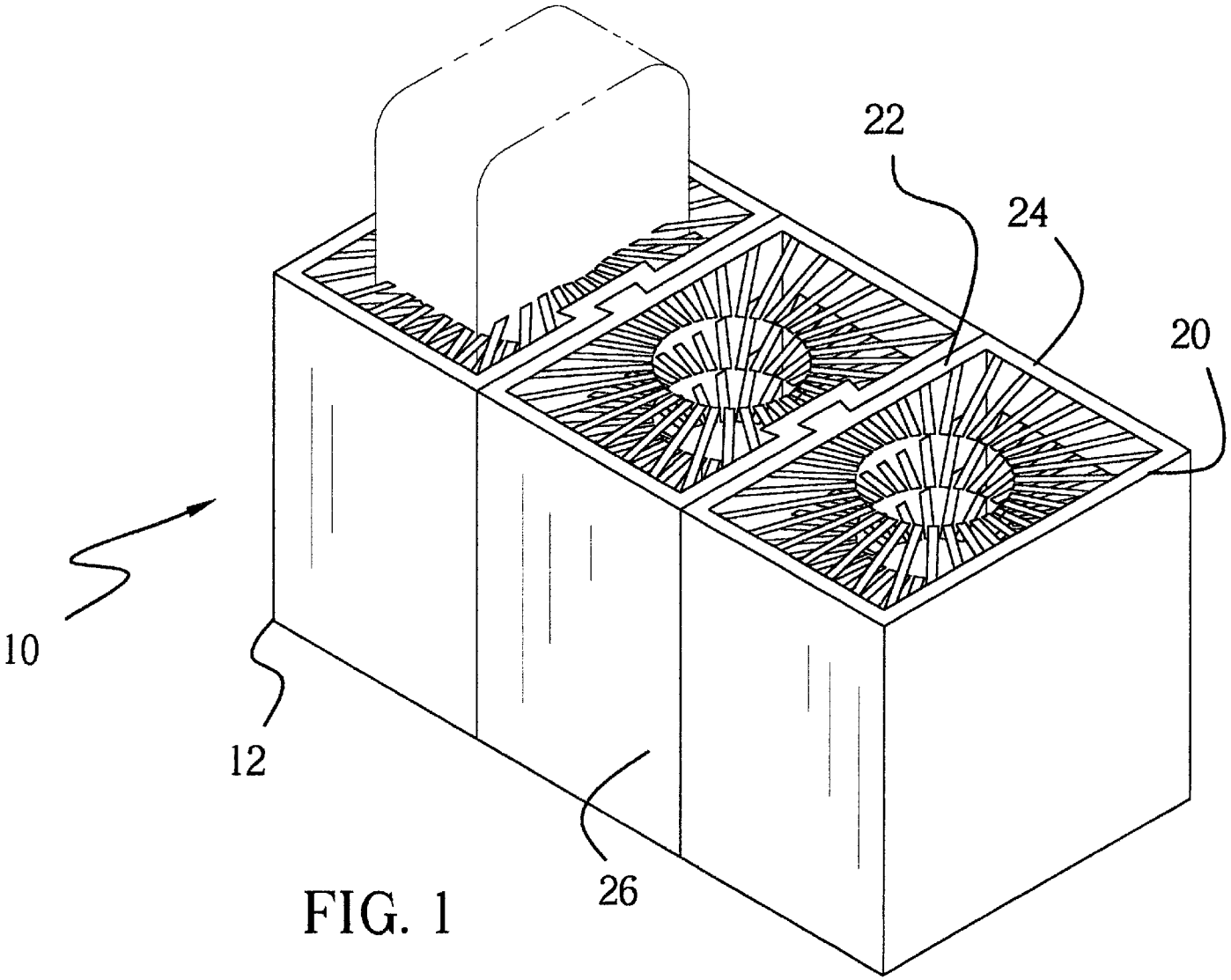
FIG. 1 is a schematic perspective view of a new container holding apparatus according to the present invention.
Figure 2:
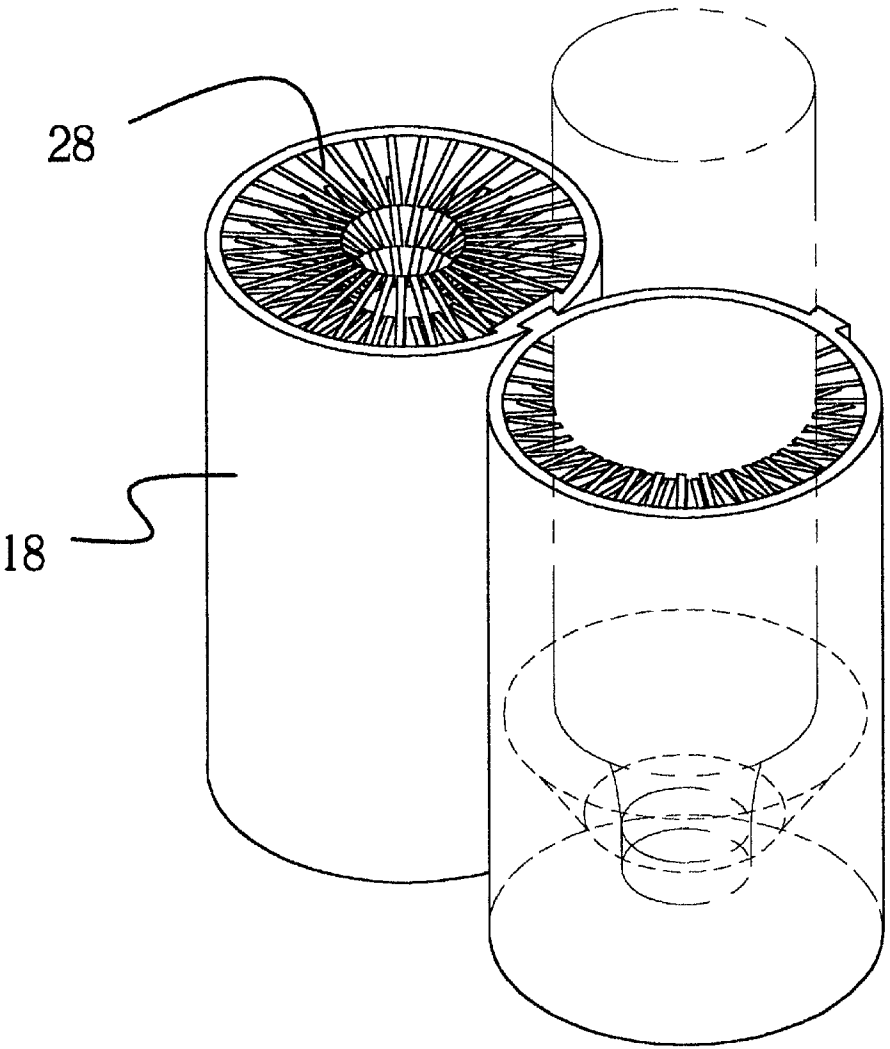
FIG. 2 is a schematic side view of a second embodiment of the present invention.
Figure 3:
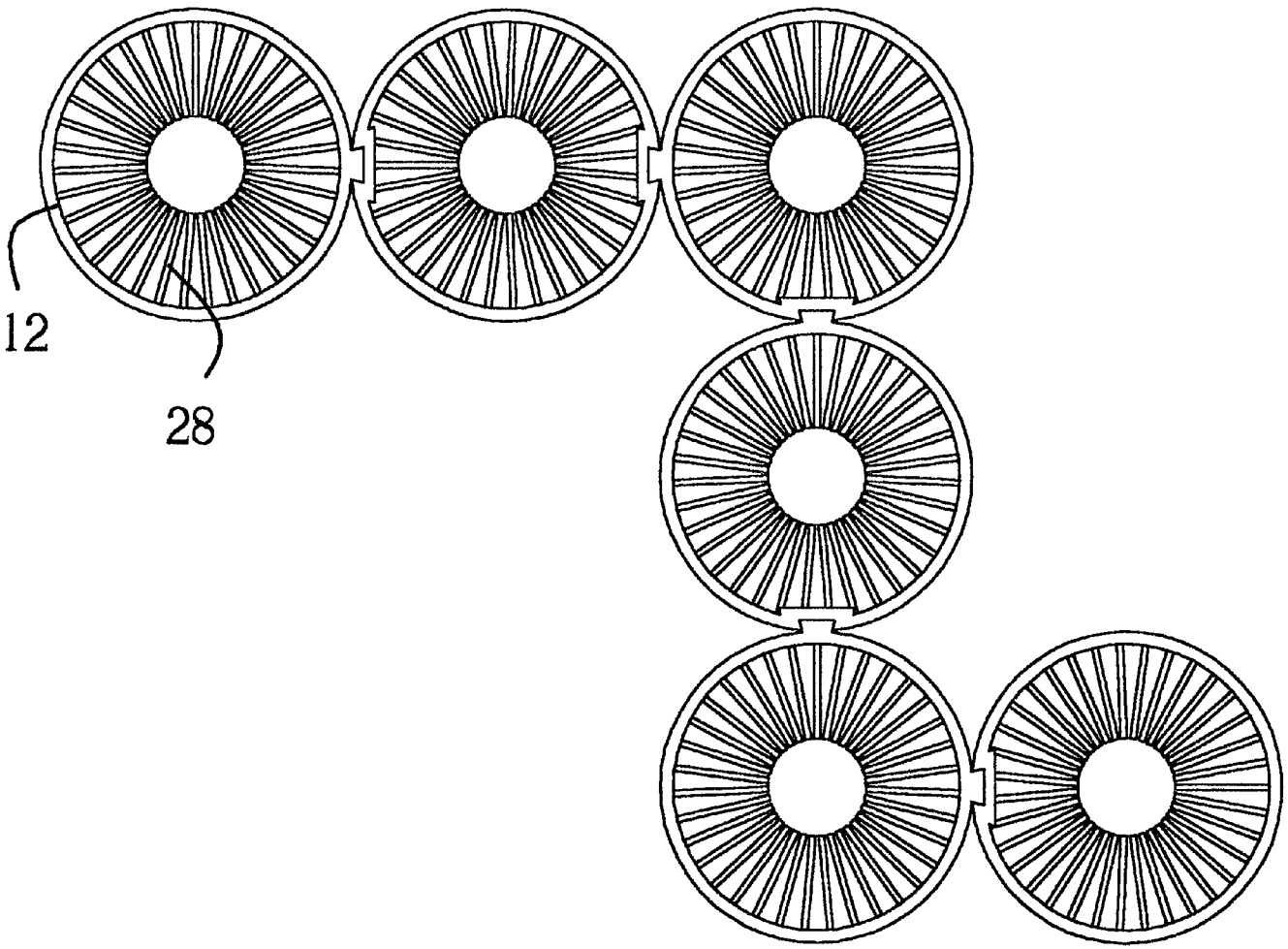
FIG. 3 is a schematic top view of the second embodiment of the present invention.
Figure 4:
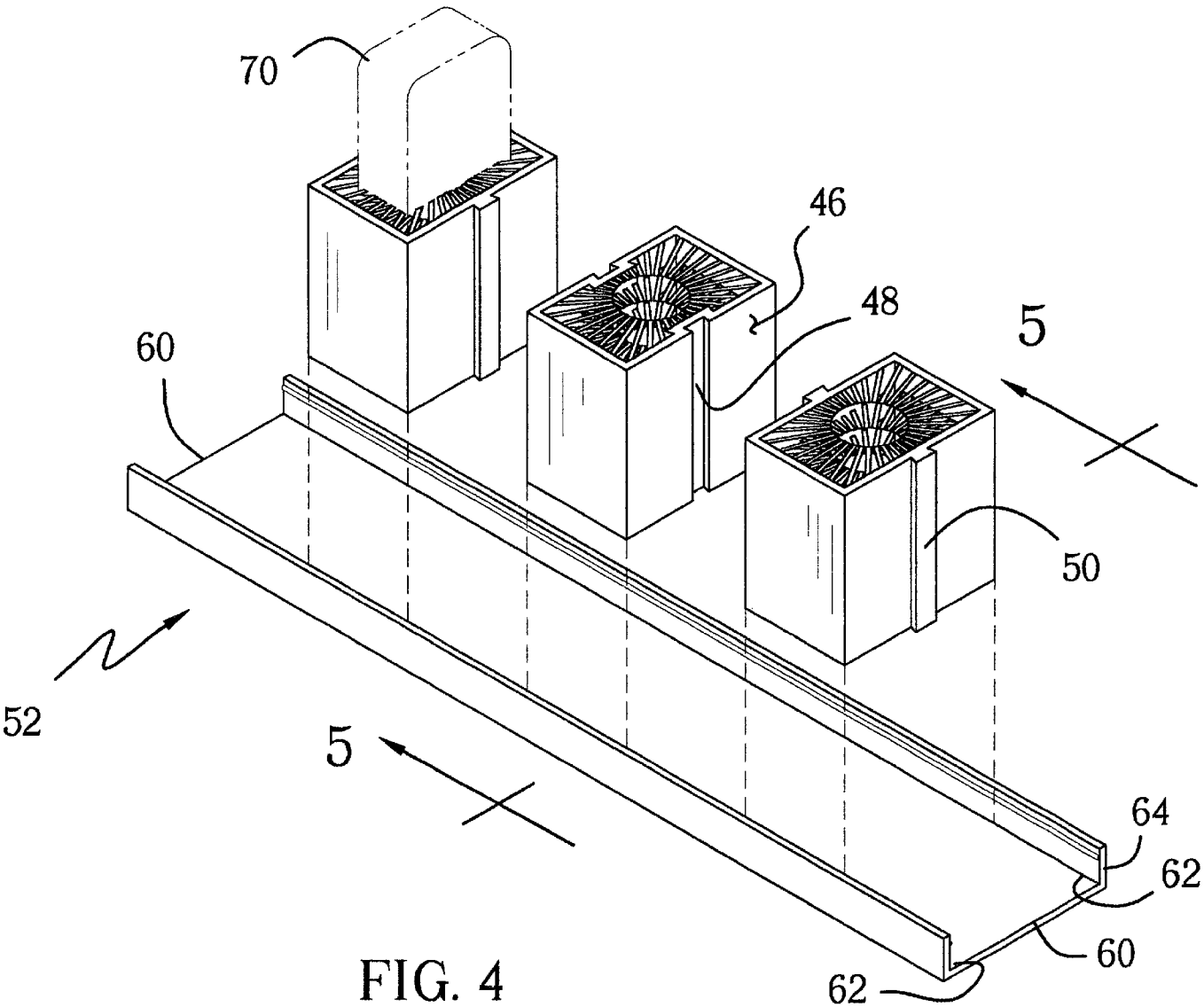
FIG. 4 is a schematic perspective view of the present invention.

With reference now to the drawings, and in particular to FIGS. 1 through 5 thereof, a new container holding apparatus embodying the principles and concepts of the present invention and generally designated by the reference numeral 10 will be described.

As best illustrated in FIGS. 1 through 5, the container holding apparatus 10 generally comprises a plurality of tubular members 12 each having a bottom edge 14, a top edge 16 and a peripheral wall 18 extending between the top 16 and bottom 14 edges. The tubular members 12 preferably have a generally rectangular shaped cross-section taken traverse to a longitudinal axis orientated perpendicular to a plain of the top edge 16, though a circular cross-section may also be employed. The peripheral walls 18 include a first side wall 20, a second side wall 22, a third side wall 24 and a fourth side wall 26. The first 20 and second 22 side walls are located opposite of each other. The peripheral walls 18 preferably comprise an elastomeric material.

A plurality of supports 28 is positioned in each of the tubular members 12. Each of the supports 28 is coupled to an inner surface 30 of the tubular member 12 and spaced from each other. An upper most support 32 is positioned adjacent to the top edge 16, and a lower most support 34 is positioned nearer the bottom edge 14 than the top edge 16. Each of the supports 28 extends from the inner surface 30 toward the longitudinal axis. Each of the supports 28 includes a plurality of elongate members 36 each having a first end 38 attached to the inner surface 30 of the peripheral wall 18 and radially extends toward the longitudinal axis of the tubular member 12. Each of the elongate members 36 has a length such that generally circular shaped openings are defined by second ends 40 of the elongate members 36. Each of the elongate members 36 comprises a resiliently flexible material, which is ideally an elastomeric material.

Each of the tubular members 12 has an intermediate wall 42 attached to the inner surface 30 and positioned between the bottom edge 14 and the lower most support 34. The intermediate walls 42 are concave with respect to the top edge 16 and extend toward the bottom edge 14. The intermediate walls 42 have a central portion having an aperture 44 extending therethrough.

Figure 5:
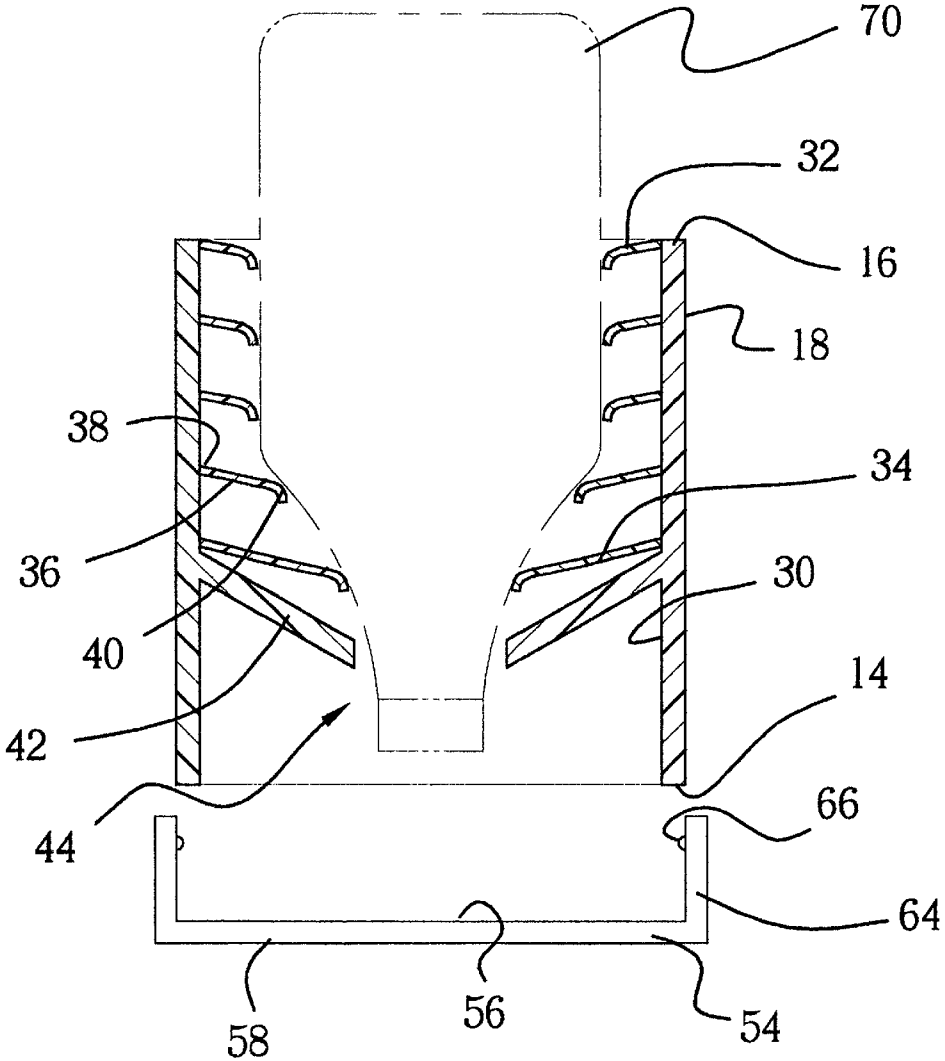
FIG. 5 is a schematic cross-sectional view taken along line 5—5 of FIG. 4 of the present invention.

Each of the peripheral walls 18 has an outer surface 46 having a slot 48 therein extending from the top edge 16 to the bottom edge 14. Each of the slots 48 is wedge-shaped such that the slots 48 expand as they extend toward the interior surface 30 of the peripheral wall 18. Each of the peripheral walls 18 has a protruding member 50 attached to the outer surface 46 and extending between the top 16 and bottom 14 edges. The protruding member 50 has a shape adapted for extending into one of the slots 48 for releasably attaching a first tubular member to a second tubular member. Alternatively, a portion of the tubular members may have slots and a portion have protruding members as depicted in FIG. 5.

A tray 52 for holding a plurality of tubular members comprises a plate 54 having a top surface 56, a bottom surface 58, a pair of end edges 60 and a pair of side edges 62. The plate 54 is elongated such that the side edges 62 have a length greater than the end edges 60. The end edges 60 have a length substantially equal to a length of the first 20 and second 22 walls of the tubular members 12. Each of a pair of lips 64 is attached to and extends upwardly from one of the side edges 62. The lips 64 extend along the length of the side edges 62. Each of a pair of elongated ridges 66 is attached to and extends along the length of inner surfaces of the lips 64 for frictionally engaging a tubular member abutting a top surface 56 of the plate 54.

In use, a container 70 is inverted and inserted into one of the tubular members 12 such that the supports 28 support the container 70 in the inverted orientation. This allows the contents, generally condiments, to fall to the top of the container for easy dispensing by a consumer and prevents the wasting of condiments which settle on the bottom of the container and are not easily accessed. The tray 52 prevents spillage on countertops or with a refrigerator.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for holding a container in an inverted position, the container being generally bottle-shaped, said system comprising:

a plurality of tubular members each having;

a bottom edge, a top edge and a peripheral wall extending between said top and bottom edges;

a plurality of supports, each of said supports being coupled to an inner surface of said tubular member and spaced from each other, each of said supports extending from said inner surface toward a longitudinal axis orientated generally perpendicular to a plane of said top edge and each of said supports having a radial length and a peripheral width, wherein the radial length is greater than the peripheral width;

wherein the container is inverted and inserted into said tubular member such that said supports support said container in said inverted orientation, and said supports comprising an upper support being positioned proximate said top edge of said tubular member and a lower most support being positioned nearer said bottom edge than said top edge such that each of the other of said supports are positioned in a spaced relation from said top support towards said bottom edge of said tubular member, each of said supports including a plurality of elongate members each having a first end attached to an inner surface of said peripheral wall and radially extending toward said longitudinal axis of said tubular member, each of said elongate members having a length such that generally circular shaped openings are defined by second ends of said elongate members, each of said elongate members comprising a resiliently flexible material such that said elongate members of said supports are adapted for supporting containers of varying sizes and shapes when the container is inserted into said tubular member; and, an intermediate wall being attached to said inner surface and positioned between said bottom edge and said lower most support, said intermediate wall being concave with respect to said top edge and extending toward said bottom edge, said intermediate wall having a central portion having an aperture extending therethrough.

2. The system for holding a container as in claim 1, wherein, said tubular member has a generally rectangular shaped cross-section taken traverse to a longitudinal axis orientated perpendicular to a plain of said top edge, said peripheral wall including a first side wall, a second side wall, a third side wall and a fourth side wall, wherein said first and second side walls are located opposite of each other.

3. The system for holding a container as in claim 2, wherein each of said peripheral walls has an outer surface having a slot therein extending from said top edge to said bottom edge, each of said slots being wedge-shaped such that said slots expand as they extend toward an interior surface of said first wall, each of said outer surfaces of said peripheral walls having a protruding member attached thereto and extending between said top and bottom edges, said protruding member having a shape adapted for extending into one of said slots for releasably attaching a first tubular member to a second tubular member.

4. The system for holding a container as in claim 1, wherein, said tubular member has a generally circular shaped cross-section taken traverse to a longitudinal axis orientated perpendicular to a plain of said top edge.

5. The system for holding a container as in claim 4, wherein each of said peripheral walls has an outer surface having a slot therein extending from said top edge to said bottom edge, each of said slots being wedge-shaped such that said slots expand as they extend toward an interior surface of said peripheral wall, each of said peripheral walls having an outer surface having a centrally located protruding member attached thereto and extending between said top and bottom edges, said protruding member having a shape adapted for extending into one of said slots for releasably attaching a first tubular member to a second tubular member.

6. The system for holding a container as in claim 1, further including:

an upper most support being positioned adjacent to said top edge, a lower most support being positioned nearer said bottom edge than said top edge; and an intermediate wall being attached to said inner surface and being positioned between said bottom edge and said lower most support, said intermediate wall being concave with respect to said top edge and extending toward said bottom edge, said intermediate wall having a central portion having an aperture extending therethrough.

7. The system for holding a container as in claim 1, further comprising:

a tray comprising a plate having a top surface, a bottom surface, a pair of end edges and a pair of side edges, said plate being elongated such that said side edges having a length greater than said end edges, said end edges having a length substantially equal to a length of said tubular members, each of a pair of lips being attached to and extending upwardly from one of said side edges, each of said lips extending along the length of the side edges, each of said lips having an inner surface, each of a pair of elongated ridges being attached to and extending along the length of one of said inner surfaces of said lips for frictionally engaging a tubular member abutting a top surface of said plate.

8. A system for holding a container in an inverted position, the container being generally bottle-shaped, said system comprising:

a plurality of tubular members each having;

a bottom edge, a top edge and a peripheral wall extending between said top and bottom edges, said tubular member having a generally rectangular shaped cross-section taken traverse to a longitudinal axis orientated perpendicular to a plain of said top edge, said peripheral wall including a first side wall, a second side wall, a third side wall and a fourth side wall, wherein said first and second side walls are located opposite of each other, said peripheral wall comprising an elastomeric material;

a plurality of supports, each of said supports being coupled to an inner surface of said tubular member and spaced from each other, an upper most support being positioned adjacent to said top edge, a lower most support being positioned nearer said bottom edge than said top edge, each of said supports extending from said inner surface toward said longitudinal axis, each of said supports including a plurality of elongate members each having a first end attached to an inner surface of said peripheral wall and radially extending toward said longitudinal axis of said tubular member, each of said elongate members having a length such that generally circular shaped openings are defined by second ends of said elongate members, each of said elongate members comprising a resiliently flexible material;

an intermediate wall being attached to said inner surface and being positioned between said bottom edge and said lower most support, said intermediate wall being concave with respect to said top edge and extending toward said bottom edge, said intermediate wall having a central portion having an aperture extending therethrough;

each of said peripheral walls having an outer surface having a slot therein extending from said top edge to said bottom edge, each of said slots being wedge-shaped such that said slots expand as they extend toward an interior surface of said peripheral wall, each of said outer surfaces of said peripheral walls having a protruding member attached thereto and extending between said top and bottom edges, said protruding member having a shape adapted for extending into one of said slots for releasably attaching a first tubular member to a second tubular member;

a tray comprising a plate having a top surface, a bottom surface, a pair of end edges and a pair of side edges, said plate being elongated such that said side edges having a length greater than said end edges, said end edges having a length substantially equal to a length of said first and second walls of said tubular members, each of a pair of lips being attached to and extending upwardly from one of said side edges, each of said lips extending along the length of the side edges, each of said lips having an inner surface, each of a pair of elongated ridges being attached to and extending along the length of one of said inner surfaces of said lips for frictionally engaging a tubular member abutting a top surface of said plate; and wherein the container is inverted and inserted into one of said tubular members such that said supports support said container in said inverted orientation.

* * * * *